United States Patent [19]

Moch

[11] Patent Number: 5,016,410

[45] Date of Patent: May 21, 1991

[54] DEVICE FOR THE LOCALIZED FASTENING OF ELEMENTS HAVING AN EDGE, ESPECIALLY OF PLATES TO A SUPPORTING STRUCTURE

[76] Inventor: Uriel P. Moch, 14, rue Claude Génin, F-38000 Grenoble, France

[21] Appl. No.: 347,891

[22] PCT Filed: Jul. 19, 1988

[86] PCT No.: PCT/FR88/00371

§ 371 Date: Mar. 15, 1989

§ 102(e) Date: Mar. 15, 1989

[87] PCT Pub. No.: WO89/00634

PCT Pub. Date: Jan. 26, 1989

[30] Foreign Application Priority Data

Jul. 21, 1987 [FR] France ..... 87 10310
Jan. 7, 1988 [FR] France ..... 88 00104

[51] Int. Cl.[5] ..... E04F 19/00

[52] U.S. Cl. ..... 52/235; 52/773; 52/775

[58] Field of Search ..... 52/235, 773, 774, 775, 52/357, 358

[56] References Cited

U.S. PATENT DOCUMENTS 2,020,815 11/1935 Venzie ..... 52/357
2,307,899 10/1941 Olsen ..... 52/357
2,613,416 10/1952 Raynor, Jr. ..... 52/358
3,025,650 3/1962 Nelsson ..... 52/357
3,121,482 2/1964 Cobb et al. ..... 52/235
3,204,383 9/1965 Adams ..... 52/232
4,578,922 4/1986 Wendt ..... 52/774

FOREIGN PATENT DOCUMENTS 112495 2/1941 Australia .
516197 12/1952 Belgium .

*Primary Examiner*—David A. Scherbel
*Assistant Examiner*—Linda J. Watson
*Attorney, Agent, or Firm*—Beveridge, DeGrandi & Weilacher

[57] ABSTRACT

Device for punctually fixing a part presenting an edge such as a plate (138) on a support structure, comprising a first element (40) fixed to the structure or integrated to the latter and presenting a hooking lug (145) as well as a second element (147) fixed to the edge of the plate and cooperating with a hooking lug in order to punctually fix the plate to the support structure. The second element (147) comprises a first portion (148) bearing against the front face of the plate, a second portion (151) engaged behind the rear face of the plate and a third portion (150) connecting said first and second portions and extending through the edge (153) of the plate. The second element (145) is at least partly elastically deformable so that its third portion (147) is deformable substantially in parallel to the edge of the plate so as to produce in one deformation direction of the portion an elastic pinching effect on the edge of the plate between the first and second portions of the second element and, in its other deformation direction a spacing between the first and second portions of the second element thereby releasing the edge of the plate.

8 Claims, 5 Drawing Sheets

FIG.4
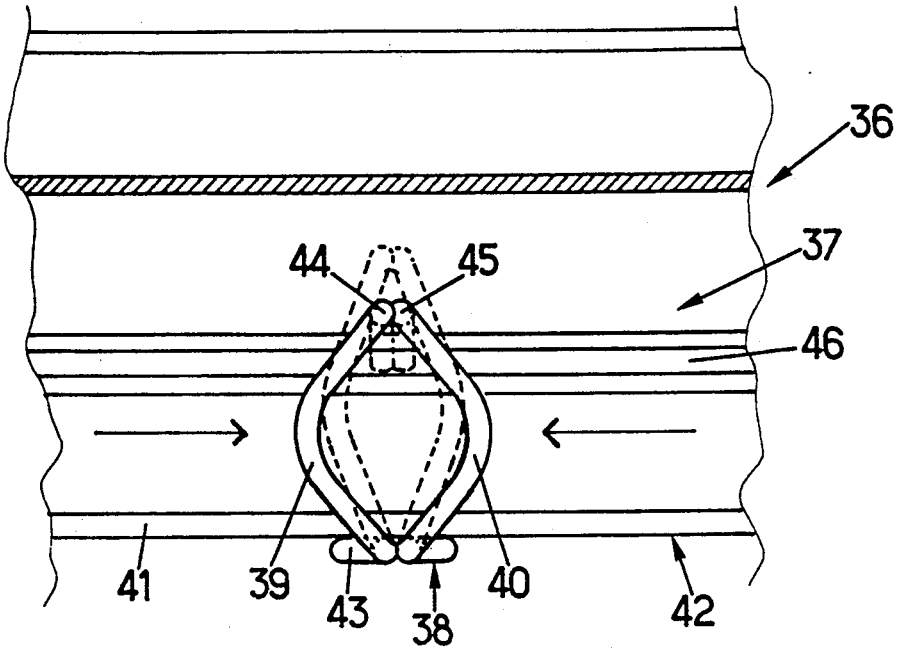
FIG.5
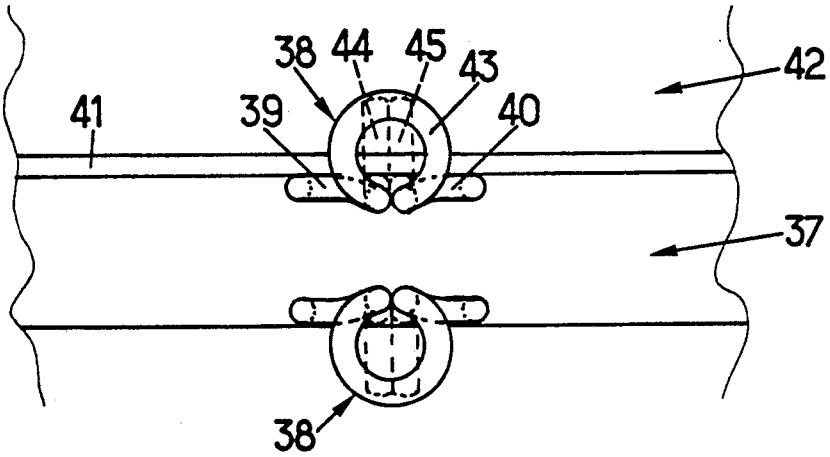
FIG.6
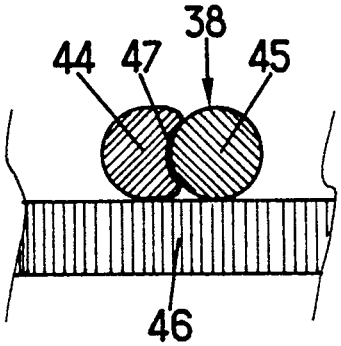
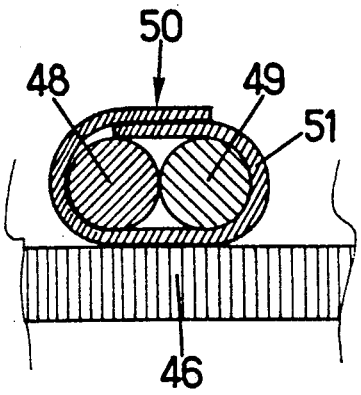
FIG.7

DEVICE FOR THE LOCALIZED FASTENING OF ELEMENTS HAVING AN EDGE, ESPECIALLY OF PLATES TO A SUPPORTING STRUCTURE

BACKGROUND OF THE INVENTION

The present invention relates to a device for the localized fastening of elements having an edge, especially of plates to a supporting structure.

In a particular use, it relates to a device for the localized fastening of plates made of building materials to a supporting structure, for the purpose of covering or forming at least partially frontages of buildings or internal walls, where the plates can be made of various building materials, for example asbestos cement, wood or glass, which are single or multi-layer.

At the present time, for the fastening of covering plates, continuous sections are often used, and these are engaged in grooves made in the end faces of the plates and are fastened to a supporting structure. In other cases, fastening members screwed to a supporting structure are used. When the plates are made of glass, they are usually adhesively bonded to a supporting structure, and auxiliary retaining and safety elements screwed to the supporting structure are added.

Furthermore, the Patent FR-A-2,531,755 shows a hook which is cut out from a metal sheet and which is fastened flat to the end face of a plate and then catches on a lug secured to the supporting structure, and the U.S. Pat. No. 2,816,436 shows a U-shaped wire engaged transversely on the edge of a plate in order to grip this, its end being fastened to a supporting structure by means of a nail.

These known arrangements are relatively complicated to put into effect and present problems especially at the time of assembly of the plates and also when one of several plates forming a surface is to be changed, for example because it is damaged.

SUMMARY OF THE INVENTION

The object of the present invention is, in particular, to overcome the disadvantages of the state of the art and provides a localized fastening device which is especially simple to produce and put into effect during both the assembly and the removal of the plates.

The device according to the invention for the localized fastening of a component having an edge, such as a plate, to a supporting structure comprises a first element fastened to the structure or integrated in this (also called the supporting member) and having a catching lug, and a second element fastened to the edge of the plate and interacting with the said catching lug, in order to fasten the plate to the supporting structure in a localized manner.

According to the invention, the said second element comprises a first part bearing against the front face of the said plate, a second part engaged behind the rear face of the said plate and a third part connecting the said first and second parts and extending across the end face of the plate, this second element being at least partially deformable elastically, in such a way that its third part is deformable substantially parallel to the end face of the plate, so as to generate, in one direction of deformation of this part, an elastic effect of gripping the edge of the plate between the said first and second parts of the second element and, in its other direction of deformation, a spreading apart of the said first and second parts of the second element, so as to release the edge of the plate. The second element will also be called the gripping element in this specification.

The invention can have many alternative embodiments, some of which are described below.

The third part of the gripping element can comprise at least one branch inclined at least partially relative to the transverse direction of the end face of the plate and elastically deformable at least parallel to the end face of the plate.

The third part of the gripping element can comprise two branches at least inclined oppositely relative to the transverse direction of the end face of the plate and parallel to the end face of the plate.

The third part of the gripping element can comprise two branches which are at least partially arcuate in opposite directions and elastically deformable parallel to the end face of the plate. These branches can be made arcuate, in such a way that their ends are close together and their central parts distant from one another.

The gripping element can be composed of a wire made of an elastically deformable material and comprising two branches forming its third part and oppositely inclined parallel to the end face of the plate, the close-together ends of these branches being joined by means of a turned loop forming one of its first or second parts, and their other ends having turned extensions forming the other of these parts.

The gripping element can be formed by a wire made of an elastically deformable material and comprising a branch arcuate parallel to the end face of the plate and forming the said third part and, at the ends of these branches, turned extensions forming the said first and second parts.

The gripping element can be composed of a wire made of an elastically deformable material and comprising two branches forming its third part, these branches being arcuate parallel to the plane of the plate, in such a way that their ends are close together and their central parts distant from one another, two corresponding ends of these branches being joined by means of a turned loop forming one of its first and second parts, and their other ends having turned extensions forming the other of these parts.

The extensions can bear one on the other, one having a groove, in which the other is engaged, and/or these extensions may be inserted in a connecting piece, especially a crimped ring.

In a special alternative manner of assembly, the second part of the said second element extends behind the catching lug of the supporting member which has a bearing zone for the rear face of the plate, the edge of the plate and this catching lug being retained or gripped between the first and second parts of the gripping element.

The bearing surfaces of the catching lug of the supporting member and of the second part of the gripping element can be made inclined correspondingly in the direction engaging this second part behind this lug.

The supporting member can comprise a part which extends outwards and against which the end face of the plate comes to bear.

The supporting member can be composed of a section which extends parallel to the edge of the plate and which comprises a longitudinal bearing zone for the plate and, set back, a longitudinal rib forming the catching lug.

This section of the supporting member may be of U-shaped cross-section, the ends of its branches forming longitudinal bearing zones for two plates placed on either side and being equipped laterally with two mutually confronting ribs which form opposite catching lugs for second retaining elements for these plates.

This section of the supporting member may include a longitudinal rib which extends outwards and bears against the end face of the plate, its rib forming the said catching lug at the rear of this bearing rib.

The rear face of the plate can bear on the bearing zone of the supporting member by means of a longitudinal sealing strip.

The deformation of the gripping element in the direction spreading apart its first and second parts can be such that this element can be extracted by being shifted perpendicularly relative to the end face of the plate.

In another special alternative manner of assembly, the second part of the gripping element bears against the rear face of the plate and, at the rear of the latter, has at least one catching lug bent towards the edge of the plate and engaging behind the catching lug of the supporting member.

The second part and catching lug of the gripping element can be such that, by pivoting, they grip the catching lug of the supporting member between them or release this, at the same time as the edge of the plate is gripped between the first and second parts of the gripping element or is released.

The gripping element can be composed of a wire made of an elastic material shaped in the manner of a hairpin which is such that its head extends against the front face of the plate and its branches extend across the end face of the plate, being inclined relative to the transverse direction of the said end face and forming a V, and extending against the rear face of this plate, the ends of its branches being bent towards the edge of the plate, so as to form catching lugs.

BRIEF DESCRIPTION OF THE DRAWINGS

The present invention will be understood better from a study of plate-fastening devices described by way of non-limiting examples and illustrated in the drawing in which:

FIG. 4 shows, in a horizontal section corresponding to that of FIG. 3, an assembly equipped with another fastening device according to the present invention;

FIG. 5 shows an outside elevation view of the assembly of FIG. 4;

FIG. 6 shows an alternative embodiment of the fastening device illustrated in FIGS. 4 and 5;

FIG. 7 shows another alternative embodiment of the fastening device illustrated in FIGS. 4 and 5;

DETAILED DESCRIPTION OF THE INVENTION

Figure 1:
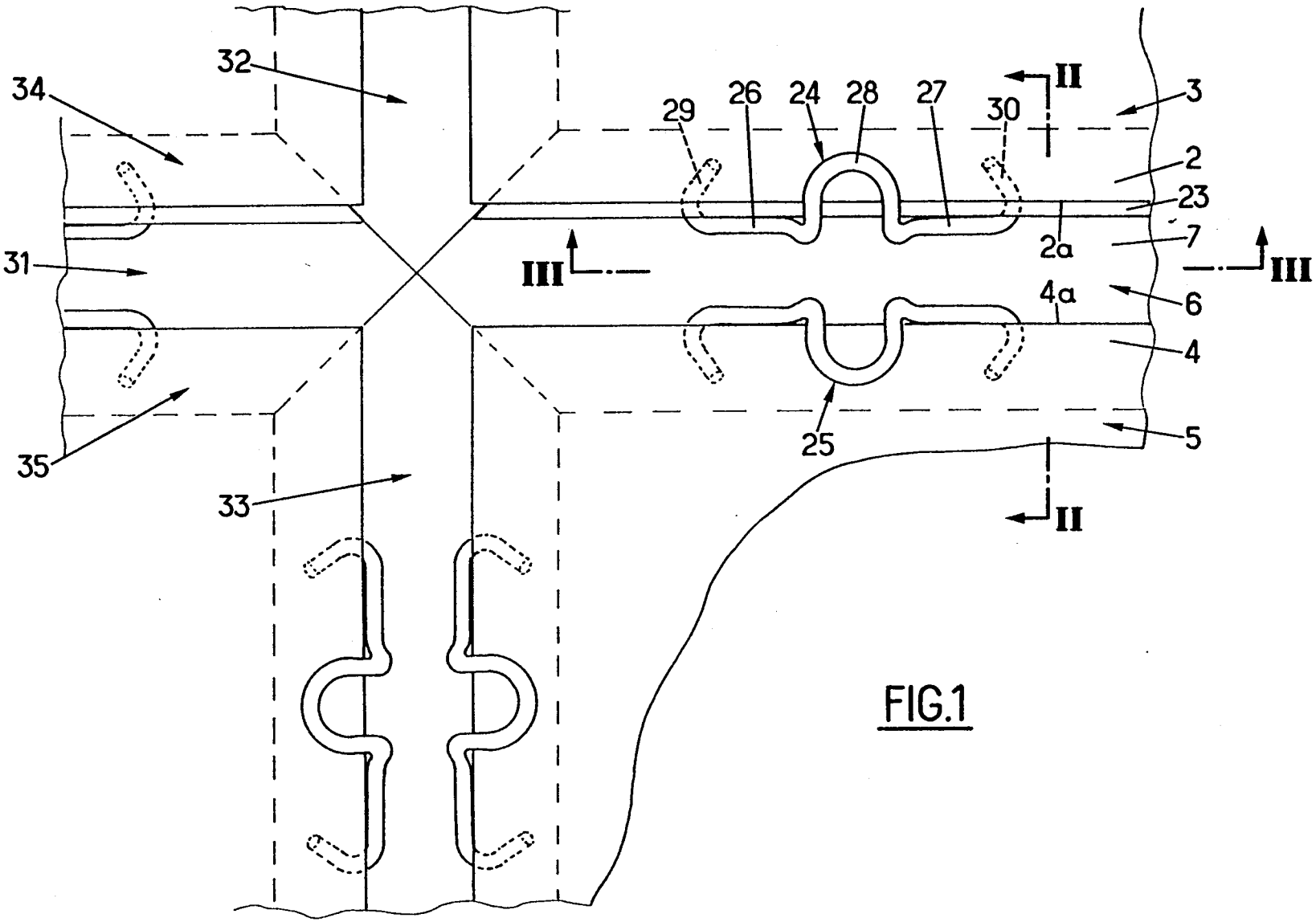
FIG. 1 shows an outside elevation view of a wall portion formed from an assembly of plates fastened by means of a first fastening device according to the present invention.
Figure 2:
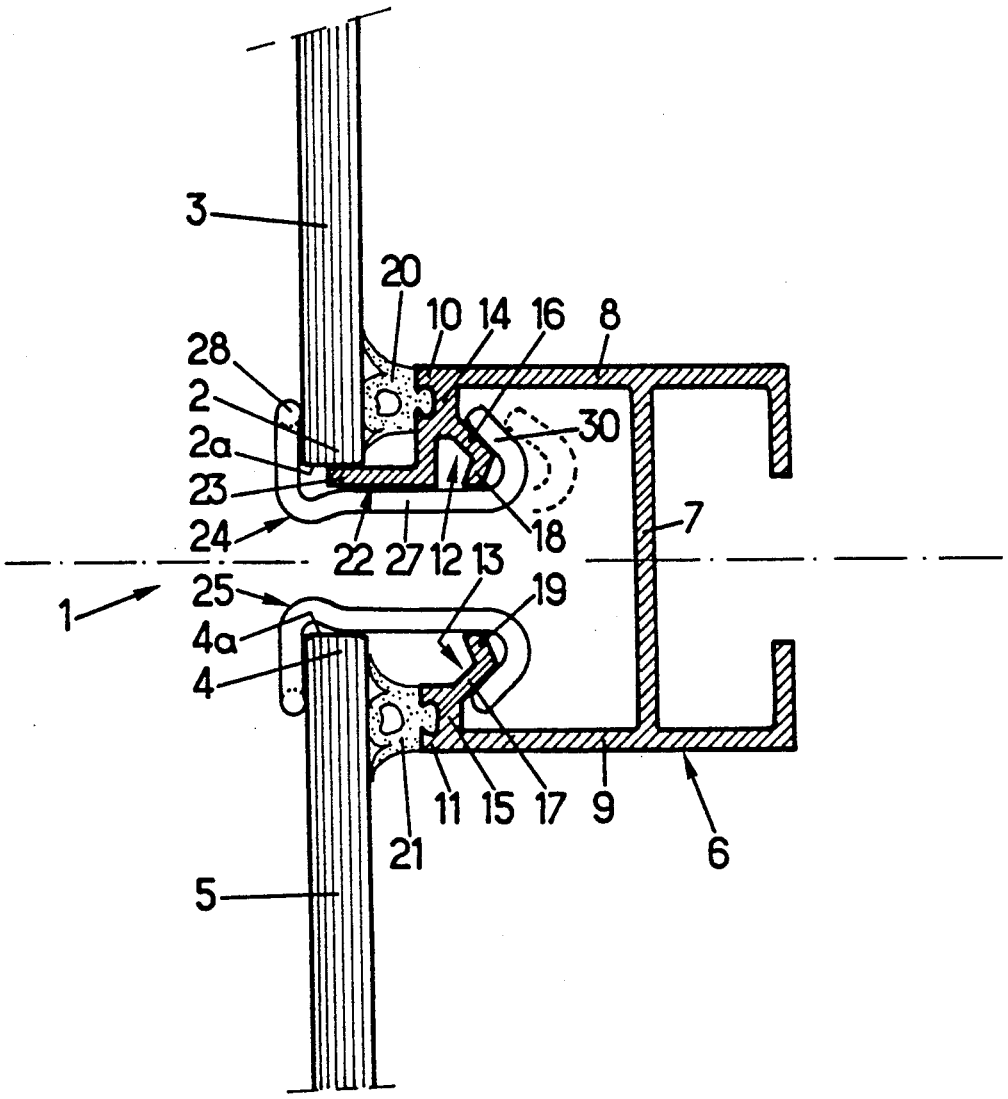
FIG. 2 shows a vertical section according to II—II of the assembly illustrated in FIG. 1.
Figure 3:
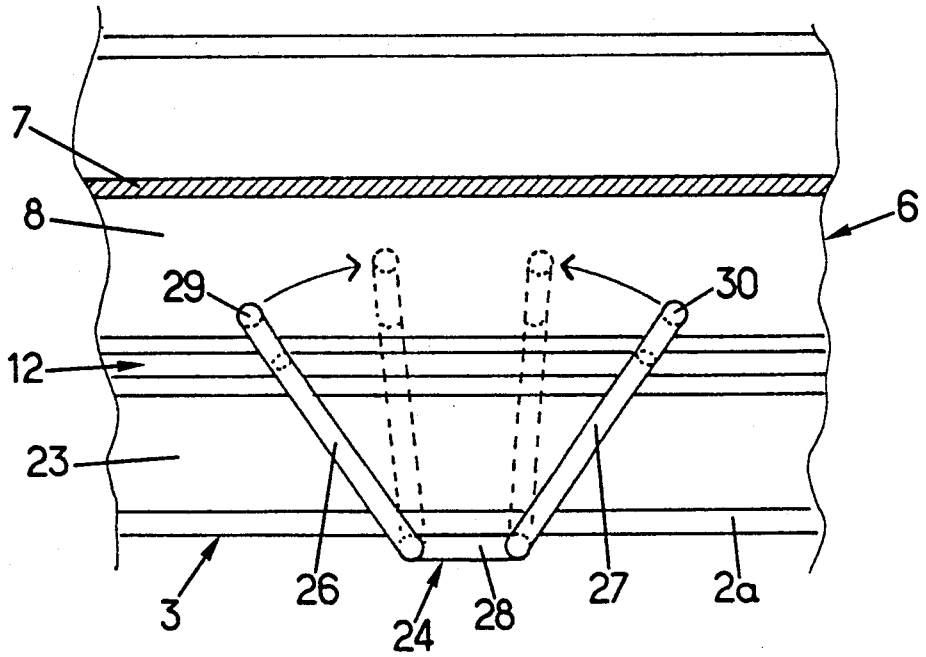
FIG. 3 shows a horizontal section according to III—III of the assembly shown in FIG. 1.

Referring to FIGS. 1 to 3, there will now be described a first fastening device designated as a whole by the reference 1 and intended, on the one hand, for retaining the horizontal lower edge 2 of a rectangular plate 3 extending vertically and, on the other hand, for retaining the horizontal upper edge 4 of a rectangular plate 5 extending vertically below and at a distance from the plate 3.

As best shown in FIG. 2, the fastening device 1 comprises a first element called a supporting member 6 comprised of a horizontal section designated and of U-shaped cross-section and comprising a vertical web 7 and two horizontal wings 8 and 9 extending at a distance from one another. The web 7 is at the opposite and at the rear of the space separating the plates 3 and 5, and the wings 8 and 9 extending towards the edges 2 and 4 of these plates.

The ends 10 and 11 of the wings 8 and 9 of the section 6 are equipped with catching lugs 12 and 13 which extend facing one another. These lugs 12 and 13 form the catching lug of the supporting member 6. In cross-section, these ribs 12 and 13 have in succession, from the ends 10 and 11 of the wings 8 and 9, parts 14 and 15 extending vertically, parts 16 and 17 inclined towards the vertical web 7 of the supporting member 6 and end parts 18 and 19 inclined in the opposite direction to the vertical web 7 of the section 6. The combination of vertical part 14, inclined part 16, and end part 18 form catching lug 12. Likewise catching lug 13 is formed from individual parts 15, 17, and 19.

Longitudinal sealing strips 20 and 21 are secured to the front faces of the ends 10 and 11 of the wings 8 and 9 of the supporting member 6 and to the parts 14 and 15 of the catching lugs 12 and 13. In the example, these front faces have a longitudinal groove and these sealing strips 20 and 21 include a longitudinal rib, the said longitudinal groove and the said longitudinal rib being engaged one in the other.

Furthermore, that part 14 of the catching lug 12 associated with the upper wing 8 of the supporting member 6 is extended, in front of the parts 16 and 18 of this catching lug 12, by a longitudinal extension 22 of L-shaped cross-section which first extends downwards and which has a horizontal branch 23 extending outwards beyond the longitudinal sealing strip 20. The longitudinal extension 22 and the horizontal branch 23 form an edge of the supporting member 6 which is parallel to the end face **2*a* of plate 3**.

As can be seen clearly from FIG. 2, the rear face of the edge 2 of the plate 3 bears against the longitudinal sealing strip 20, and its lower end face **2*a* bears on the horizontal branch 23 of the longitudinal extension 22 of the supporting member 6, and the inner face of the edge 4 of the plate 5 bears on the longitudinal sealing strip 21, its upper end face 4*a* being horizontally level with the end 19 of the catching lug 13 of the lower wing 9 of the supporting member 6**.

The fastening device 1 also possesses, on the one hand, a gripping element shown generally at 24 and, on the other hand, another gripping element shown generally at 25. These elements respectively retain the plates 3 and 5 on the horizontal supporting member 6, and the gripping elements 24 and 25 are of identical structure.

In particular, the gripping element 24 is formed by a wire made of an elastically deformable material, for example steel, which comprises a first part 28 bearing against the front face of the plate 3, a second part 30 engaged behind the catching lug 12 of the supporting member 6 and a third part 26 and 27 confronting the end face 2a of the plate 3, these parts being constructed in the following way.

The gripping element 24 comprises two straight branches 26 and 27 (making up the third part of the gripping element 24) which extend across the lower end face of the plate 3 and which bear on the lower face of the horizontal branch 23 of the longitudinal extension 22 of the supporting member 6. These branches 26 and 27 are inclined relative to the transverse direction of the end face 2a of the plate 3, so as to form a V divergent towards the vertical web 7 of the supporting member 6.

The close-together ends of the branches 26 and 27 of the gripping element 24 are joined by means of a loop 28 which forms the first part of the gripping element 24, and is turned upwards and which comes to bear against the outer face of the lower edge 2 of the plate 3. The other ends of the gripping element 24 have extensions 29 and 30 which form the second part of the gripping element, which are turned up at the rear of the parts 16 and 18 of the catching lug 12 of the supporting member 6 and which bear on the part 16 of this lug, in such a way that they tend to engage behind the latter in the direction of part 14. It will therefore be seen that the parts 16 and 18 form a catching lug 12 for the gripping element 24.

The gripping element 24 is formed so as to generate a spring effect which tends, parallel to the end face 2a of the plate 3, to open the angle of its branches 26 and 27 forming its third part and reduce the passageway defined, on the one hand, by its first part composed of the loop 28 and, on the other hand, by its second part composed of extensions 29 and 30 bearing respectively on the front face of the plate 3 and on the catching lug composed of the wings 16 and 18 of the section 6. As a result of this, therefore, the edge 2 of the plate 3 is gripped between, on the one hand, the loop 28 of the gripping element 24 bearing on its front face and, on the other hand, the sealing strip 20 bearing on its rear face.

In order to remove the gripping element 24, for example, the jaw of a pair of pliers is introduced between the plates 3 and 5 towards the vertical web 7 of the supporting member 6, and the furthest ends of the branches 26 and 27 are gripped on either side, in order to reclose the V formed by these branches 26 and 27 and, by pivoting, bring the extensions 29 and 30 closer together parallel to the end face 2a of the plate 3, and the branches 26 and 27 pivoting relative to the loop 28 and the extensions 29 and 30 moving away from the catching lug 12 of the supporting member 6. When the branches 26 and 27 are brought into substantially parallel positions, as represented by broken lines in FIG. 3, so as to extend substantially in the transverse direction of the end face 2a of the plate, the gripping element 24 is made to slide in the direction moving it away from the end face 2a of the plate 3, thus freeing the extensions 29 and 30 from the catching lug 12 of the supporting member 6. The gripping element 24 is then removed by extracting it from the supporting member 6 and by causing it to pass between the edges of the plates 3 and 5.

The procedure for assembling the gripping element 24 is carried out in reverse order. A gripping element 24 is taken and is gripped so as to close the V formed by its branches 26 and 27 by bringing their extensions 29 and 30 closer together. The gripping element 24 is slid into the supporting member 6 so as to bring its extensions 29 and 30 to the rear of the catching lug 12 of the supporting member 6 and its loop 28 to bear against the outer face of the edge 2 of the plate 3, and then it is released. The spring effect of the gripping element 24 brings it into the position for clamping the plate 3, as shown in FIGS. 1 to 3 and described above. It is possible advantageously to change the position of the gripping element 24 along the edge 2 of the plate 3 by gripping it, as before, so as to open gripping element 24 and make it slide along.

The gripping element 25, of a structure identical to that of the gripping element 24, functions and can be assembled and removed in the same way as the latter. Its two branches inclined relative to the transverse direction of the edge 4 of the plate 5 bear on the end face 4a of this plate and on the end part 19 of the catching lug 13. Its turned loop bears on the front face of the edge 4 of the plate 5, and the turned extensions of its branches are engaged behind the parts 17 and 19 of the catching lug 13 of the supporting member 6.

Referring to FIG. 1, it will be seen that the horizontal section of the supporting member 6 forms a horizontal branch of a cross-shaped supporting structure which comprises another horizontal section 31 in the extension of the supporting member 6 and two vertical sections 32 and 33, these four sections being connected by means of a bevel cut and, if appropriate, being fastened to a basic supporting structure. The horizontal section 31 is of the same cross-section as the horizontal section of the supporting member 6, whilst the sections 32 and 33 have the cross-section of the horizontal section of the supporting member 6 without the longitudinal bearing extension 22.

As a result of the horizontal section 31, the lower edge of a plate 34 and the upper edge of a plate 35, which are adjacent to the plates 3 and 5, can be fastened by means of fastening elements similar to the preceding gripping elements 24 and 25 and assembled in the same way. As a result of the vertical sections 32 and 33, the vertical edges of the plate 3 and 5 and the vertical edges of the plates 34 and 35 can be fastened by means of fastening elements similar to the elements 24 and 25 and functioning in the same way.

As a result of the structure illustrated particularly in FIG. 1, the edges of vertical plates forming a vertical wall can be retained at any suitably selected points on a supporting structure formed from various intersecting sections arranged horizontally and vertically. The wall thus obtained is also leakproof because of the peripheral sealing strips, such as 20 and 21, which are associated with the various sections and against which the edges of the plates bear.

Referring now to FIGS. 4 and 5, there will now be described another fastening device designated as a whole by the reference 36 and comprising a supporting member, shown generally at 37 and identical to the supporting member 6 of the preceding example, and a gripping element designated as a whole by the reference 38 and used in the same way as the gripping element 24 described in the preceding example.

This gripping element 38, likewise composed of a wire made of an elastically deformable material, preferably steel, differs from the gripping element 24 in that its branches 39 and 40, (which make up the third part of the gripping element 38) extending across the end face 41 of a vertical plate 42 which it is to retain, are arcuate, in such a way that their ends are adjacent and their central parts are distant from one another. These branches 39 and 40 extend into the plane parallel to the end face 41 of the plate 42.

As in the preceding example, the outer ends of the branches 39 and 40 of the gripping element 38 are joined by means of a loop 43 which forms the first part of the gripping element 38 and which bears against the outer face of the plate 42, and the inner ends of these branches 39 and 40 likewise have parallel extensions 44 and 45 turned at the rear of a longitudinal catching lug 46 of the supporting member 36, as in the preceding example, these extensions this time being adjacent. The extensions 44 and 45 form the second part of the gripping element 38.

Referring to FIG. 6, it will be seen that the extension 44 of the branch 39 has a longitudinal groove 47, into which the curve of the extension 45 of the branch 40 is slightly engaged. Referring to FIG. 7, this shows an alternative embodiment, in which the branches 48 and 49 which form the second part of a gripping element 50, otherwise identical to the gripping element 38, are surrounded by a crimped ring 51.

The gripping element 38 is designed to retain the plate 42 on the supporting member 36 by gripping, in the same way as the gripping element 24 of the preceding example. This time, however, the spring effect of the gripping element 38 tends to bring its extensions 44 and 45 located at the rear of the catching lug 46 of the supporting member 36 closer to its loop 43 located at the front of the plate 42, the central parts of the branches 39 and 40 tending to move away from one another.

If action is taken, for example by means of pliers, on the moved-apart central parts of the branches 39 and 40 of the gripping element 38 in the direction bringing them closer together, parallel to the end face 41 of the plate 42, its extensions 44 and 45 move away from its loop 43. The gripping element 38 is then in the position represented by broken lines in FIG. 4. In this position, the gripping element 38 can be separated from the supporting member 36 in the same way as the gripping element 24 of the preceding example. To assemble it, branches 39 and 40 are gripped again, and the gripping element 38 is brought into position in such a way that its extensions 44 and 45 extend at the rear of the catching lug 46 of the supporting member 36 and its loop 43 at the front of the plate 42, and it is then released. The gripping element 38 assumes its above-described clamping position under the effect of its elasticity.

By means of one of the two arrangements described with reference to FIGS. 6 and 7, the extensions 44 and 45 of the gripping element 38 and the extensions 48 and 49 of the equivalent gripping element 50 are maintained in contact during the operations of assembly and removal and therefore cannot engage one above the other.

The examples described above are not limiting. In particular, the sections could have notches in their catching ribs, so it is possible to assemble and remove the second wire-shaped fastening elements by sliding parallel to the sections, after their extensions and loops have been spread apart. The sections could be replaced by short elements fastened to a supporting structure. The sealing strips could be omitted. The second elements serving for gripping could be of a different structure, whilst at the same time functioning in an equivalent way, and in particular the second elements of FIGS. 4 and 5 could comprise only a single arcuate branch equipped with turned extensions at its ends.

Figures 8, 9:
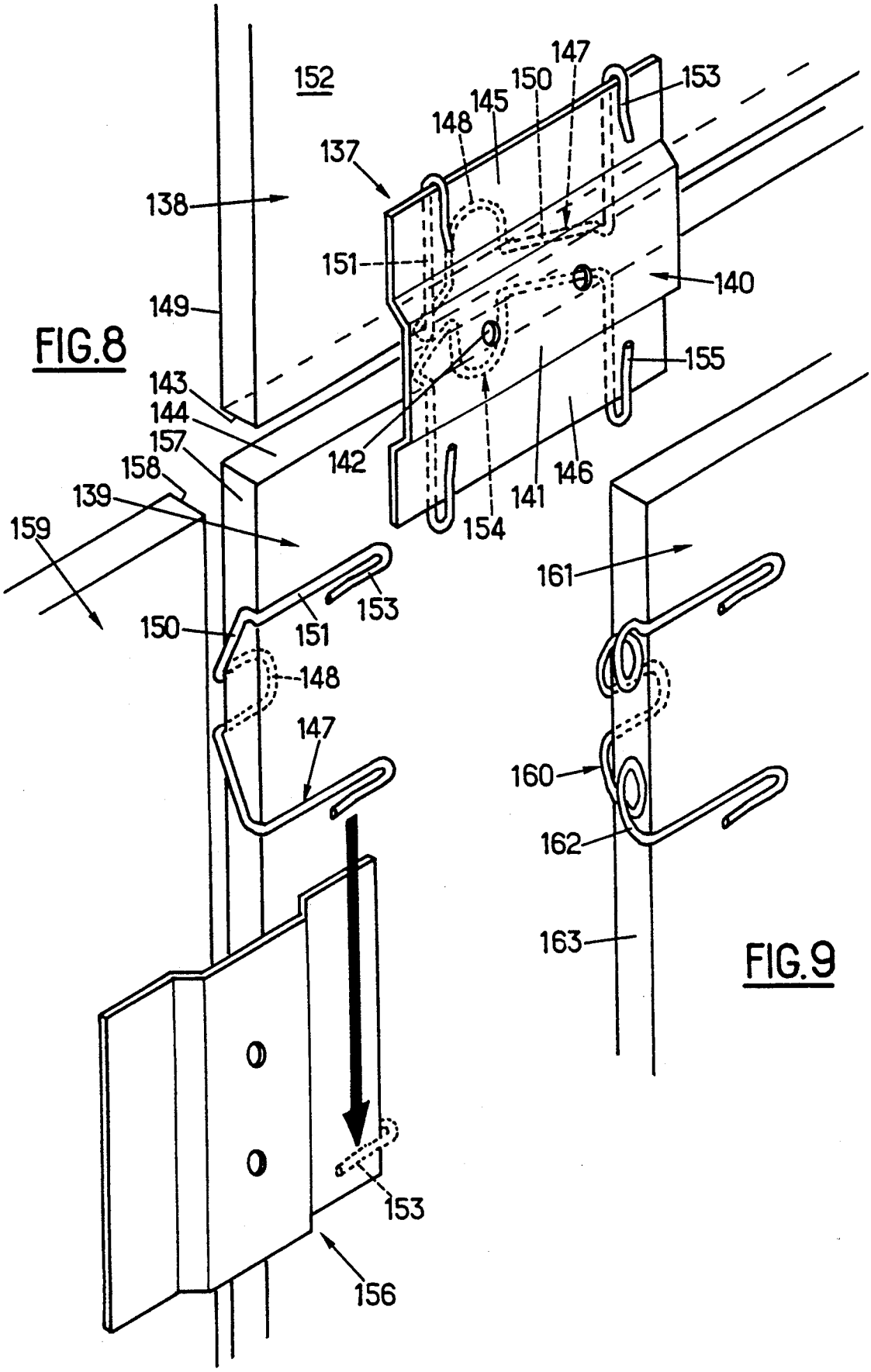
FIG. 8 shows a perspective rear view of plates assembled by means of another localized fastening device according to the present invention.
FIG. 9 shows in perspective an alternative embodiment of one of the elements of the fastening devices shown in FIG. 4.

Referring now to FIG. 8, there will be described another fastening device designated as a whole by the reference 137 and designed for retaining the lower part of a vertical plate 138 and the upper part of a vertical plate 139 placed underneath, in relation to a vertical supporting structure (not shown).

The fastening device 137 comprises a first fastening element designated as a whole by the reference 140 and comprising a flat part 141 bearing on and fastened to the front face of the supporting structure by means of screws (not shown) extending through two holes 142 provided laterally relative to the horizontal end faces 143 and 144 of the plates 138 and 139 and opposite the space separating them. The flat part 141 is extended upwards and downwards by two vertical catching lugs 145 and 146 which are offset outwards relative to the front face of the supporting structure, the end edge of these catching lugs 145 and 146 being horizontal.

The fastening device 137 also possesses a wire fastening element designated as a whole by the reference 147 (a gripping element) and, in this example, composed of a wire made of an elastic material. This wire 147 is formed in the manner of a hairpin, the branches of which are bent perpendicularly relative to their plane, so as to define a groove which comprises a first part bearing against the front face of the plate 138, a second part bearing against its rear face and a third part bearing against its end face and in which the lower part of the plate 138 is gripped.

The wire 147 comprises a head 148 (forming the first part of the gripping wire 147) bearing against the outer face 149 of the plate 138, two branch parts 150 (forming the third part of the gripping wire 147) bearing against the lower horizontal end face 143 of the plate 138 and inclined in the plane of the end face 143 relative to the transverse direction of this end face 143, at the same time opening, and, in the extension of these branch parts 150, two branch parts 151 which extend vertically and upwards and which bear against the rear face 152 of the plate 138. The upper ends of these branch parts 151 are extended by parts bent towards the edge 143 of the plate 138, forming catching lugs 153 (forming the second part of the gripping wire 147) which are engaged behind the upper catching lug 145 of the fastening element 140 so as to carry the plate 138.

As a result of the elasticity of the wire 147, the branch parts 150 tend to open by pivoting parallel to the end face 143 of the plate 138 and thus move the branch parts 151 away from one another. This effect ensures that the lower edge of the plate is gripped between the head 148 and the branch parts 151 of the wire 147. Furthermore, the branch parts 151 bearing against the rear face 152 of the plate 138 and catching lugs 153 extending them are arranged relative to one another in such a way as to grip the upper catching lug 145 of the first fastening element 140 by pivoting parallel to the lower end face 143 of the plate 138.

The fastening device 137 also possesses a second wire fastening element designated as a whole by the reference 154, which is identical to the wire fastening element 147 described above and which is mounted on the upper edge of the plate 139, opposite to the wire fastening 147, in such a way that its catching lugs 155 are engaged behind the lower catching lug 146 of the first fastening element 140.

It can be seen that FIG. 8 partially illustrates another fastening device, designated as a whole by the reference 156, which is identical to the preceding fastening device 137, but which is oriented at 90 degrees relative to the latter, so as to retain the adjacent vertical edges 157 and 158 of the plate 139 and of another vertical plate 159.

An assembly of plates comprising particularly the plates 138, 139 and 159 can especially be mounted on a supporting structure in the following way by means of devices identical to the fastening devices 137 and 156.

First of all, a set of first fastening elements 140 is fastened to the supporting structure, these being distributed according to the dimensions of the plates, in such a way that each plate can, for example, be retained at two locations on each of their sides.

Two wire fastening elements 147 are mounted on each of the edges of the plates. The plates are offered to the supporting structure in succession at the locations where they are to be mounted, and the second fastening elements are positioned and attached in the following way.

For example by means of pliers which are engaged on the side of the end face of the plate 138 being fastened, perpendicularly relative to the front face of the latter, the branch parts 150 of the wire 147 are grasped so as to bring them closer together by causing them to pivot towards one another parallel to the end face 143 of the plate 138. The edge of the plate 138 being released in this way, by means of the pliers the wire 147 is made to slide along the end face 143 of this plate, in order to engage the catching lug 145 of the element 140 fastened to the supporting structure between the rear branch parts 150 and the catching lugs 153 of the wire 147, and then the pliers are opened and withdrawn. The branch parts 150 open and the branch parts 151 pivot, at the same time spreading apart in such a way that the edge of the plate 138 is gripped between these branch part 151 and the head 148, at the same time as the branch parts 151 and the catching lugs 153 pivot in order to grip the catching lug 145 between them.

The above-mentioned operations are repeated for each of the plates to be fastened.

The various plates are thus retained on the supporting structure. They can also be removed separately by proceeding in reverse order, the pliers engaging into the spaces separating the plates.

Referring to FIG. 9, it can be seen that this shows another embodiment of a wire fastening element, designated as a whole by the reference 160, which is mounted on the edge of a plate 161 and the structure of which differs from that of the wire fastening element 147 only in that its branch parts 162 bearing against the end face 163 of the plate 161 form a loop which makes it possible to fit the wire fastening element 160 onto edges of plates 161 having very different thicknesses.

Of course, that part of the fastening devices described with reference to FIGS. 8 and 9 which grips the edge of the plate could have the structure of the fastening devices described with reference to FIGS. 4 to 7.

The fastening devices which have just been described can be put to many uses, especially for constructing the cladding of building frontages or for constructing all walls or coverings, both internal and external, vertical, inclined or horizontal, by means of plates which can be made of very different materials.

The present invention is not limited to the examples described above. Many alternative embodiments are possible, without departing from the scope defined by the accompanying claims.

I claim:

1. A device for the localized fastening of a plate to a supporting member having a catching lug extending behind the plate, said plate having a front face, a rear face, an edge, and an end face, said catching lug having an edge, said supporting member having an edge parallel to the end face of the plate, the fastening device comprising:

a gripping element having a first part bearing against the front face of the plate, a second part engaged behind the rear face of the plate and a third part connecting the first and second parts thereof and extending across the end face of the plate, said gripping element being elastically deformable parallel to the end face of said plate so as to bring closer said first and second parts thereof, said second part of the gripping element having an end lug means engaged behind said catching lug of the supporting member so as to grip the edge of the catching lug, said elastically deformable gripping element generating an elastic effect for simultaneously gripping the edge of said plate and the edge of said catching lug, said first and second parts of said gripping element being forced to spread apart when opposite forces are exerted on the third part of said gripping element, wherein the edge of the plate and the edge of the catching lug are simultaneously released and the gripping element is movable along the edge of the plate and the edge of the catching lug.

2. A device for the localized fastening of a plate to a supporting member having a catching lug extending behind the plate, said plate having a front face, a rear face, an edge, and an end face, said catching lug having an edge, said supporting member further having an edge opposite and parallel to the end face of the plate, the fastening device comprising:

a wire means having a first part bearing against the front face of the plate, a second part engaged behind the rear face of the plate and a third part connecting the first and second parts of said wire means and extending across the end face of the plate, said wire means being elastically deformable parallel to the end face of the plate so as to grip the edge of the plate between the first and second parts thereof, said second part of said wire means extending between the plate and the catching lug and having an end lug means turning around and engaged behind an edge of the catching lug of the supporting member so as to grip the edge of the catching lug, said wire means generating an elastic effect for simultaneously gripping the edge of said plate and the edge of said catching lug, said first and second parts being forced to spread apart when opposite forces are exerted on the third part parallel to the end face of the plate, wherein the edge of the plate and the edge of the catching lug, by pivoting of said second part, are simultaneously released and the gripping element is movable along the edge of the plate and the edge of the catching lug.

3. A device for the localized fastening of a plate to a supporting member having a catching lug extending behind the plate, said plate having a front face, a rear face, an edge, and an end face, said catching lug having an edge, said supporting member having an edge opposite and parallel to the end face of the plate, the fastening device comprising:

a gripping wire means made of an elastically deformable material and shaped as a pin and comprising a head and two branches, said head of the pin bearing against the front face of the plate, said branches of the pin being bent so as to have inclined transverse portions extending across the end face of the plate and forming a V, said branches further having rear portions extending against the rear face of the plate and having end lugs bent around and engaged behind the catching lug of the supporting member, said elastically deformable wire means generating an elastic effect for gripping the edge of said plate between said head and said rear portions thereof and simultaneously the edge of said catching lug of said supporting structure, said head and said branches thereof being forced to spread apart when opposite forces are exerted on said V portion thereof parallel to the end face of the plate, the edge of the plate and the edge of the catching lug of the supporting member being simultaneously released so that said wire means is movable along the edge of the plate and the edge of the catching lug when the rear portions of the branches are pivoted.

4. A device according to claim 3, wherein said rear portions of said pin extend perpendicularly to the end face of the plate, said end lugs being inclined.

5. A device according to claim 3, wherein said V portions of the pin are opened opposite to the front face of the plate.

6. A device for the localized fastening of a plate to a supporting member having a catching lug extending behind the plate, said plate having a front face, a rear face, an edge, and an end face, said catching lug having an edge, said supporting member further having an edge parallel to an end face of the plate, the fastening device comprising:

a gripping wire means having a first part bearing against the front face of the plate, a second part engaged behind the rear face of said catching lug and a third part connecting the first and second parts thereof and extending across the end face of the plate and the edge of the catching lug, said wire means being elastically deformable so as to bring closer said first and second parts of said wire means, a bearing surface of said catching lug of the supporting member and said second part of the wire means being inclined in a direction such that said second part of the wire means is engaged behind said catching lug, said elastically deformable wire means generating an elastic effect for simultaneously gripping the edge of said plate and the edge of said catching lug between said first and second parts thereof, said first and second parts thereof being forced to spread apart when opposite forces are exerted on the third part of said gripping wire means, wherein the edge of the plate and the edge of the catching lug are simultaneously released and the gripping element is movable along the edge of the plate and the edge of the catching lug.

7. A device according to claim 6, wherein said wire means is shaped as a pin, bent so as to have a head bearing against the front of the plate; branches extending across the end face of the plate and the edge of the catching lug of the supporting member and, said branches forming a V; said branches having end lugs extending behind the edge of the catching lug.

8. A device according to claim 6, wherein said wire means comprises two branches extending across the edge of the plate and the edge of the catching lug of the supporting member, said branches being arcuate such that central parts of the branches are distant from one another and the branch ends are close together, said branches being connected by a head bearing against said front face of the plate, at least one of said branches having a bend end lug engaged behind the edge of the catching lug of the supporting member.

* * * * *